US010113750B2

(12) United States Patent
Klemm et al.

(10) Patent No.: US 10,113,750 B2
(45) Date of Patent: Oct. 30, 2018

(54) VAPOR EXTRACTOR DEVICE COMPRISING A MOBILE VAPOR EXTRACTOR HOOD

(71) Applicant: BSH Bosch und Siemens Hausgeräte GmbH, Munich (DE)

(72) Inventors: Jochen Klemm, Sandhausen (DE); Ulmar Neumann, Forst (DE)

(73) Assignee: BSH Hausgeräte GmbH, Munich (DE)

( * ) Notice: Subject to any disclaimer, the term of this patent is extended or adjusted under 35 U.S.C. 154(b) by 765 days.

(21) Appl. No.: 14/423,145

(22) PCT Filed: Aug. 13, 2013

(86) PCT No.: PCT/EP2013/066862
§ 371 (c)(1),
(2) Date: Feb. 23, 2015

(87) PCT Pub. No.: WO2014/032958
PCT Pub. Date: Mar. 6, 2014

(65) Prior Publication Data
US 2015/0211750 A1 Jul. 30, 2015

(30) Foreign Application Priority Data
Aug. 27, 2012 (DE) ..... 10 2012 215 144

(51) Int. Cl.
*F24C 15/20* (2006.01)

(52) U.S. Cl.
CPC ..... *F24C 15/2042* (2013.01); *F24C 15/2092* (2013.01)

(58) Field of Classification Search
CPC ..... F24C 15/2092; F24C 15/2042
USPC ..... 126/299 R; 454/63, 64
See application file for complete search history.

(56) References Cited

U.S. PATENT DOCUMENTS 4,151,408 A * 4/1979 Brown ..... F24J 2/38 126/575
4,295,129 A * 10/1981 Cade ..... F23N 5/242 110/193
6,814,658 B1 * 11/2004 Rindoks ..... E05D 13/14 454/56
6,914,219 B2 * 7/2005 Kuhne ..... F24C 15/322 126/21 A
2007/0137635 A1 6/2007 Feisthammel et al.
2007/0137636 A1 * 6/2007 Mack ..... F24C 15/2092 126/299 D (Continued)

FOREIGN PATENT DOCUMENTS

DE 102009001852 A1 9/2010
WO 0173353 A1 10/2001

OTHER PUBLICATIONS

International Search Report PCT/EP2013/066862 dated Oct. 10, 2013.

*Primary Examiner* — Avinash Savani
*Assistant Examiner* — Aaron Heyamoto
(74) *Attorney, Agent, or Firm* — Michael E. Tschupp; Andre Pallapies; Brandon G. Braun

(57) ABSTRACT

A vapor extractor device includes a vapor extractor hood, and a drive motor for retracting and extending the vapor extractor hood. The drive motor is hereby controlled to reduce a retraction speed of the vapor extractor hood from a first predetermined retraction position, when the vapor extractor hood is retracted.

22 Claims, 6 Drawing Sheets

(56) References Cited

U.S. PATENT DOCUMENTS

| | | | | |
|---|---|---|---|---|
| 2007/0295324 | A1 | 12/2007 | Feisthammel et al. | |
| 2008/0314374 | A1 | 12/2008 | Bally et al. | |
| 2010/0059040 | A1 | 3/2010 | Shaffer et al. | |
| 2010/0236278 | A1* | 9/2010 | Eom | F25D 23/021 62/449 |

* cited by examiner

VAPOR EXTRACTOR DEVICE COMPRISING A MOBILE VAPOR EXTRACTOR HOOD

BACKGROUND OF THE INVENTION

The invention relates to a vapor extractor device with a vapor extractor hood that can be retracted and extended by means of a drive motor.

DE 10 2004 055 945 A1 describes a vapor extractor device, in which a suction component of a vapor extractor device comprises a suction shield, which is extended or retracted in response to a user input. An actuation component is positioned on an operating facility of the vapor extractor hood for inputting an extension or retraction command relating to the extension facility.

DE 10 2005 055 181 A1 describes a cooking appliance with a vapor extractor device that has a visible frame that can be retracted and extended vertically. To provide protection against trapping, a drive mechanism is provided, which moves the visible frame between an extended and a lowered position by way of a drive motor and has at least two switches for switching the drive motor off and at least one actuation element for actuating the switches. At least one of the switches is actuated by way of the actuation element as a function of a force acting on the visible frame from the outside. The elastic support of the actuation element at a constant distance from the switches and relative movement in a guide mean that a mechanical protection function is implemented in the drive mechanism without electronic means.

DE 10 2009 001 852 A1 describes a cooking appliance with a vapor extractor device that has a visible shield that can be retracted and extended vertically, it being possible to extend the visible shield automatically by means of a lever unit with a compression spring.

BRIEF SUMMARY OF THE INVENTION

It is the object of the present invention to embody a vapor extractor device with a vapor extractor hood that can be retracted and extended by means of a drive motor in such a manner that it allows safer operation.

This object is achieved according to the features of the independent claims. Preferred embodiments will emerge from the dependent claims in particular.

The object is achieved by a vapor extractor device with a vapor extractor hood that can be retracted and extended by means of a drive motor, the vapor extractor device being set up to reduce a retraction speed from a first predetermined retraction position when the vapor extractor hood is retracted.

The vapor extractor hood can therefore be moved first at a high speed from an open or extended position, in particular an extended end position, and then as it approaches a closed or retracted end position (closing position) it can be moved at a slower speed. In other words the vapor extractor hood is first retracted in a fast movement mode. When it reaches the first retraction position, a switch is then made to a slow movement mode, in which the vapor extractor hood continues to move more slowly.

This vapor extractor hood has the advantage that a user has more time to remove a finger from the opening for the vapor extractor hood. If said user does not do this, the lower retraction speed reduces the momentum of the vapor extractor hood and therefore the possible severity of squashing.

The vapor extractor hood may in particular have at least one filter for filtering air flowing through. The at least one filter may be a grease filter for example. The vapor extractor hood may also have a frame to hold the edges of the filter. One or more operating elements may be arranged on the frame, in particular on its upper face, which is accessible in the retracted state. At least one operating element (in particular switch, including button, e.g. push button) may serve to retract, extend and/or (manually or automatically) activate the vapor extractor hood on actuation. At least one operating element may serve to set a suction power of the vapor extractor facility. The vapor extractor hood can simply be raised again in the event of trapping by actuating a corresponding operating element, in particular a push button.

A predetermined first retraction position refers in particular to a position along the movement path of the vapor extractor hood, which is reached before complete retraction of the vapor extractor hood into a housing of the vapor extractor device. The first retraction position is therefore located in particular between the extended end position and the closing position. This first retraction position is in particular predetermined such that there is no interruption of operation or threat to safety as a result of the vapor extractor hood closing too quickly.

In one development the first retraction position is located in a position on the travel path approx. 80 mm before the retracted end position is reached and therefore the speed of the retracting vapor extractor hood is reduced approx. 80 mm before the closing position.

In a further development the retraction speed of the vapor extractor hood drops to below 12 mm/s when the first retraction position is reached or in slow movement mode. This increases the certainty of a user for example having more time to identify the threat of a trapping situation.

In one embodiment the reduced retraction speed is canceled when a second retraction position is reached, which follows the first retraction position in the retraction direction. In other words the vapor extractor hood is moved more quickly again when it reaches the second retraction position. In particular a switch is made back from slow movement mode to fast movement mode so that further movement can be undertaken again at the original high speed in the direction of the closing end position. This embodiment has the advantage that the vapor extractor hood is reliably moved into the end position and it is ensured that it does not stop beforehand.

In one development the second retraction position is located in a region from 2 to 5 mm before the closing position of the vapor extractor hood. At such a small distance from the closing position it is no longer possible for a user or even a child to trap his/her fingers.

In a further embodiment the vapor extractor device has a position determination facility for determining at least the first retraction position. The use of a dedicated position determination facility allows particularly reliable and precise determination that at least the first retraction position has been reached.

Alternatively or additionally a retraction position of the vapor extractor hood can be derived for example from a movement of the drive motor, for example by means of an analysis of a motor signal. For example the current retraction position can be concluded from the knowledge of a number of rotations of a motor shaft from the extended end position. The drive motor can be embodied in particular as a multiphase motor here.

The position determination facility can be implemented in different ways. The position determination facility can detect the retraction position of the vapor extractor hood continuously or just in at least one predetermined retraction position.

In one development the retraction position can be determined contactlessly by means of the position determination facility, for example by means of a light barrier, magnetically (e.g. by means of a reed relay), inductively or capacitively (e.g. by means of a capacitive proximity sensor).

In an alternative or additional development the retraction position can be determined mechanically (not contactlessly) by means of the position determination facility. This allows particularly robust and simple determination. In one embodiment of such the position determination facility is a mechanical switch. The switch can in particular be a switch in the narrower sense or a button.

In a further embodiment the position determination facility has an actuation element for actuating the switch in the form of a rail positioned on the vapor extractor hood. The rail is moved together with the rest of the vapor extractor hood in the retraction direction. When the rail meets the switch, it actuates it. This embodiment has the advantage that the switch can be positioned comparatively freely in the vapor extractor device and can be switched precisely. The shape of the rail is not restricted in principle and may be embodied in particular in the manner of a plate, angle, etc., in particular made of sheet metal.

In one embodiment the rail has a front slope in the retraction direction for actuating the switch. Therefore the rail does not move suddenly onto the switch to activate slow movement mode, which in turn assists with reliable actuation and prevents the switch for example catching on the rail.

In one development the switch is arranged on the vapor extractor hood and the rail is arranged in the vapor extractor device in a stationary manner.

In one development the other side of the rail (the rearward side in the retraction direction) has a slope for activating fast movement mode in the second retraction position.

In a further embodiment a drive speed of the drive motor can be set as a function of voltage, a resistor is connected in series to the drive motor (in a motor controller) and the resistor can be bypassed as a function of at least one retraction position of the vapor extractor hood. This embodiment has the advantage that the slower retraction speed can be set precisely with particularly simple means. In particular the resistor is bypassed in fast movement mode so that the full voltage can be present at the drive motor and is not bypassed in slow movement mode so that a voltage can drop by way of the resistor. In other words such a motor controller can be embodied in particular in the manner of an activation circuit to activate the drive motor, with a drive voltage being applied directly to the drive motor depending on the switching position or being applied to the drive motor at a reduced level with the resistor connected in between.

In one development the resistor can be bypassed by means of the position determination facility. This allows the resistor to be connected to or decoupled from the power circuit simply and reliably. To this end the position determination facility can act in the manner of an electrical, electronic or mechanical switch of the motor controller.

The drive speed of the motor may be for example a motor speed (e.g. rotation speed) of the drive motor.

In particular a mechanical switch, in particular a microswitch, is actuated approx. 80 mm before the closing position is reached, thereby connecting the resistor. This reduces the voltage at the drive motor so that the motor speed drops until the movement speed of the vapor extractor hood drops below 12 mm/s. If trapping occurs at the end stage of the closing movement, less clamping force acts on a finger or object trapped inadvertently or even deliberately, as the drive motor closes the vapor extractor hood with less force.

In a further embodiment the drive motor is a direct current motor, in particular a brushless direct current motor, and a diode is connected parallel to the resistor in such a manner that the diode bypasses the resistor when the polarity is such that the vapor extractor hood is extended. In other words when the vapor extractor hood is retracted at a reduced retraction speed, the drive voltage is applied to the drive motor with a predetermined polarity by way of the resistor so that a current flow passes through the resistor and the drive motor. It is only necessary to reverse the polarity in order to extend the vapor extractor hood. The current flow from the voltage source then flows directly through the drive motor and the diode, said diode bypassing the resistor regardless of the position of the vapor extractor hood. The full voltage (in other words not reduced by the resistor) is therefore always present at the drive motor to extend the vapor extractor hood. This means that the vapor extractor hood can always be extended quickly.

In a general embodiment a movement speed is not specifically reduced when extending the vapor extractor hood.

In a further embodiment the vapor extractor device has a housing to accommodate the vapor extractor hood and (at least) one spring, the spring being arranged on the housing or on the vapor extractor hood and a carrier is arranged on the vapor extractor hood or on the housing in such a manner that the carrier engages with the spring from a third retraction position. The spring brings about a reduction of the weight of the vapor extractor hood from the third retraction position, so that if a finger is trapped, the vapor extractor hood does not rest thereon with its full weight but with a weight reduced by the action of the spring force. This is because the spring changes shape elastically due to the engagement with the carrier and thus a spring force counter to the retraction direction is exerted on the vapor extractor device. In other words it is preferable for a reduction of the weight of the vapor extractor hood to be brought about by engagement of carrier and spring at the same time as or after the switch from fast movement mode to slow movement mode.

In one development a carrier is arranged on the vapor extractor hood, being able to engage with one end of the spring or a rail connected thereto, the other end of the spring being fastened to the housing of the vapor extractor device. The spring here can in particular be connected at its movable end to a carriage, said carriage being able to engage with the carrier. This assists an elongation of the spring in a straight line without tilting or curving and the like.

In an alternative development thereof one end of the spring is fastened to the vapor extractor hood and the other end of the spring engages with a carrier, which is arranged in a fixed position in the housing.

Depending on the structural embodiment the spring can be a tension spring, a compression spring, a scroll spring or even some other type of spring that is extended or compressed as a result of the action of the carrier.

In one embodiment the third retraction position in the retraction direction is identical to the first retraction position or follows the first retraction position.

In a further development the third retraction position (and therefore the weight reduction or the engagement of carrier and spring) takes place approx. 65 mm before the closing position is reached.

The vapor extractor device can be a separate appliance, for example for integration in a worktop.

The object is also achieved by a cooking appliance, which has such a vapor extractor device. The cooking appliance can be configured in a similar manner to the vapor extractor device and can achieve the same advantages.

The cooking appliance can be or have in particular a deep fat fryer or a cooktop. The vapor extractor device here is arranged in particular in a region behind a deep fat fryer or a cooktop in the cooking appliance and can be extended in particular vertically upward therefrom.

BRIEF DESCRIPTION OF THE DRAWINGS

The invention is described schematically in more detail in the figures which follow with reference to an exemplary embodiment. Identical elements or those with the same action may be provided with identical reference characters for the sake of clarity.

DETAILED DESCRIPTION OF EXEMPLARY EMBODIMENTS OF THE PRESENT INVENTION

Figure 1:
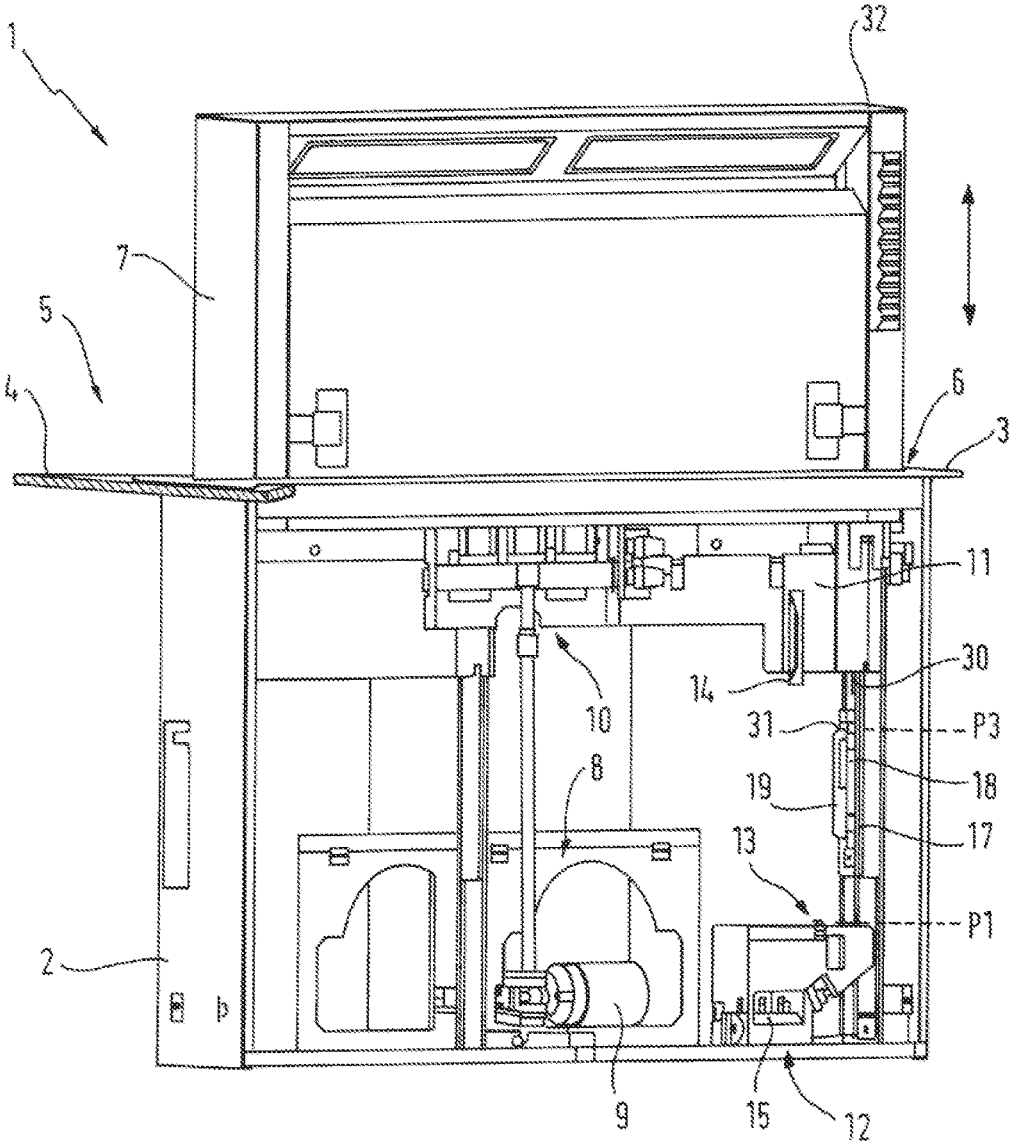
FIG. 1 shows a section of a cooking appliance and components of a vapor extractor device inserted therein with a movable vapor extractor hood.

FIG. 1 shows components of a vapor extractor device 1. The upper housing edge 3 of a housing 2 of the vapor extractor device 1 is inserted into an upper face 4 of a cooking appliance 5. The housing 2 can be structured in the manner of a frame or is shown without a front housing wall for illustration purposes.

A housing opening 6 is configured within the upper housing edge 3. A vapor extractor hood 7 can be extended upward through the housing opening 6 into an extended end position in particular for use. When the vapor extractor device 1 is not required, the vapor extractor hood 7 can be retracted downward into the housing 2 into a lower end position or closing position. The flat upper face 32 of the vapor extractor hood 7 can then lie flush with the upper housing edge 3. Buttons (not shown) are arranged on the upper face 32 to operate the vapor extractor hood 7, for example to extend, retract, set a suction power, etc.

For the purposes of extending and retracting the vapor extractor device 1 has a drive unit 8 with a drive motor 9 in the form of a brushless direct current motor. The drive motor 9 is arranged in the housing 2 and coupled by way of force transmission elements 10 to the vapor extractor hood 7 or to a bottom plate 11 of the vapor extractor hood 7.

To activate the drive motor 9 a drive voltage can be activated by way of (only partially shown) electronic components and switching elements subject to program control and/or by manual intervention on the part of a user. In particular a drive voltage can be applied to the drive motor 9 as a direct current voltage with a polarity to extend the vapor extractor hood 7 at a first, fast speed upward out of the housing 3 into the upper end position. By reversing the polarity of the drive voltage applied to the drive motor 9 it is possible to retract the vapor extractor hood 7 again at in particular the same first, fast speed, in particular to its closing position.

A control facility 12 is arranged in the housing 2 to reduce a retraction speed of the vapor extractor hood 7 as it is retracted into the housing 2 before it reaches the end position. In particular the control facility 12 has a switch 13. The switch 13 can be actuated by a rail 14, which is arranged on the vapor extractor hood 7 or on the plate 11 and can therefore be moved in an upward or downward direction with this.

The control facility 12 has an ohmic resistor 15. Depending on the switching position of the switch 13 the drive voltage is either applied directly to the drive motor 9 to move the vapor extractor hood 7 quickly or it is applied to the drive motor 9 with the resistor 15 connected in between to move the vapor extractor hood 7 slowly.

When the vapor extractor hood 7 is retracted from the upper end position shown, the drive motor 9 initially moves the vapor extractor hood 7 in a fast movement mode at the high first speed downward into the housing 2. When a first retraction position P1 is reached, which is in particular defined as a position shortly before the closing position is reached, the rail 14 actuates the switch 13. This connects the resistor 15 in series to the drive motor 9 so that further retraction of the vapor extractor hood 7 in the direction of the closing position is brought about by the drive motor 9 at a reduced speed.

It also shows an arrangement for reducing an effective weight force of the vapor extractor hood 7 as it is retracted into the housing 2. This arrangement consists of a guide rail 17 supported in a fixed position in the housing 2 and a spring 18, fastened at one end to the guide rail 17 and therefore fastened to the housing 2 in a fixed position. A carriage 19 is supported in the guide rail 17, the other end of the spring 18 being fastened thereto. The carriage 19, which is bent and manufactured in particular from sheet metal, has a carrier stop 31, which engages with a carrier 30 in a third retraction position P3 when the vapor extractor hood 7 is retracted, the carrier 30 being configured or arranged on the vapor extractor hood 7 or on the plate 11. Therefore when the vapor extractor hood 7 reaches the third retraction position P3, the subsequent pressure of the carrier 30 against the carrier stop 31 causes the spring 18 to be subjected to a force and the further movement of the vapor extractor hood 7 or the force of the vapor extractor hood 7 acting as a result of the movement to be counteracted.

Figure 2A:
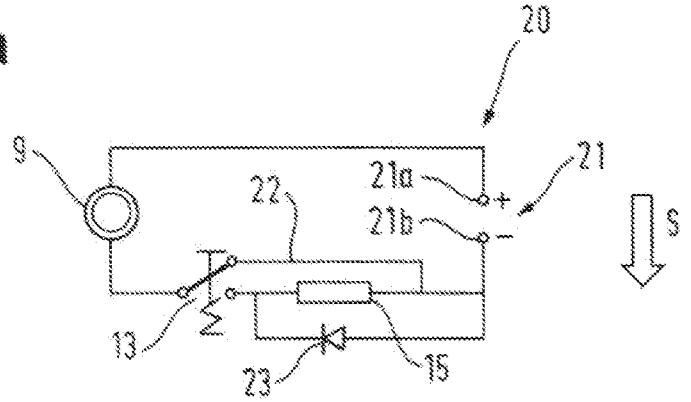
FIGS. 2*a-c* show a motor controller for a drive motor of the vapor extractor hood according to FIG. 1 in three different switching states.
Figure 2B:
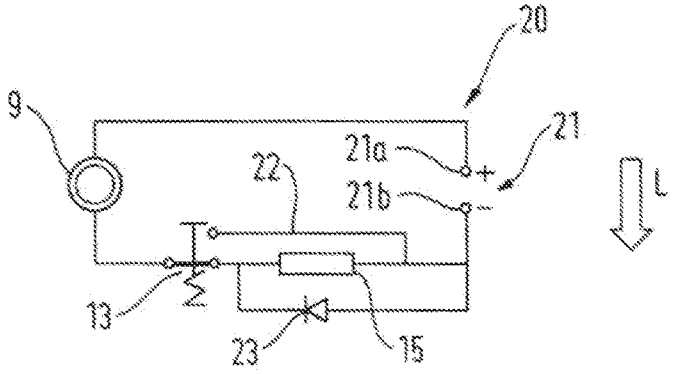
Figure 2C:
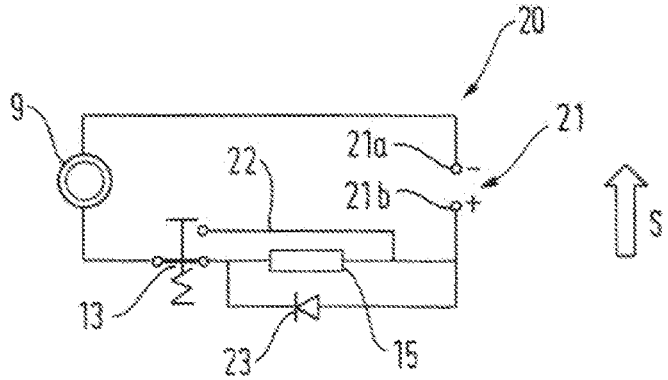

FIGS. 2*a* to 2*c* show an exemplary engine controller 20 in three different switching states. They show an electrical direct current voltage connector 21, which supplies the drive voltage for the drive motor 9.

For a fast movement S of the vapor extractor hood 7 in the retraction direction, as shown in FIG. 2*a*, a first, positive pole 21*a* of the direct current voltage connector 21 is connected directly to a connector of the drive motor 9. The other connector of the drive motor 9 is connected to the switch 13. In the switching state shown for this mode of operation the switch 13 connects the drive motor 9 by way of a bypass line 22 directly to the second, negative pole 21*b* of the electrical connector 21. The full voltage of the electrical connector 21 is therefore present at the drive motor 9. This allows a fast movement mode S with fast retraction of the vapor extractor hood 7 to be achieved before the first retraction position P1 is reached.

When the vapor extractor hood 7 reaches the first retraction position P1, the switch 13 is moved to the other switching position, as shown in FIG. 2*b* and FIG. 2*c*. In this switching position the switch 13 connects the drive motor 9 both to the electrical resistor 15 and also to a diode 23 connected parallel thereto. The resistor 15 and the diode 23 are therefore connected between the switch 13 and the second pole 21*b*. The anode of the diode 23 here is connected to the second pole 21*b*.

During retraction of the vapor extractor hood 7 into the housing 2, as shown in FIG. 2*b*, a drive current therefore flows through the series circuit comprising the drive motor 9 and the resistor 15. The diode 23 however blocks. This reduces the effective drive voltage at the drive motor 9 so that it reduces its drive speed and therefore the retraction speed of the vapor extractor hood 7. The vapor extractor hood 7 therefore switches to a slow movement mode L.

During normal extension of the vapor extractor hood 7 or even in the event of a fault, reverse switching can take place automatically and/or for example by a user pushing a touch element, depending on the embodiment. Reverse switching brings about a polarity reversal of the electrical connector 21 so that the drive motor 9, which is designed as a direct current motor, moves the vapor extractor hood 7 in the counter direction, in other words upward, and extends it out of the housing 2 again. The diode 23 here is connected in such a manner that the current flows through the series circuit comprising the drive motor 9, the switch 13 and the diode 23. The diode 23 therefore acts in the manner of a current direction-dependent bypass element.

In other words the diode 23 blocks during retraction and in slow movement mode L the drive motor 9 only receives the reduced voltage by way of the resistor 15. When the polarity of the direct current voltage is reversed during extension, the resistor 15 is bypassed by the through-switching diode 23 and the drive motor 9 is supplied with the, for example, full 24 V drive voltage and extends quickly.

Figure 3:
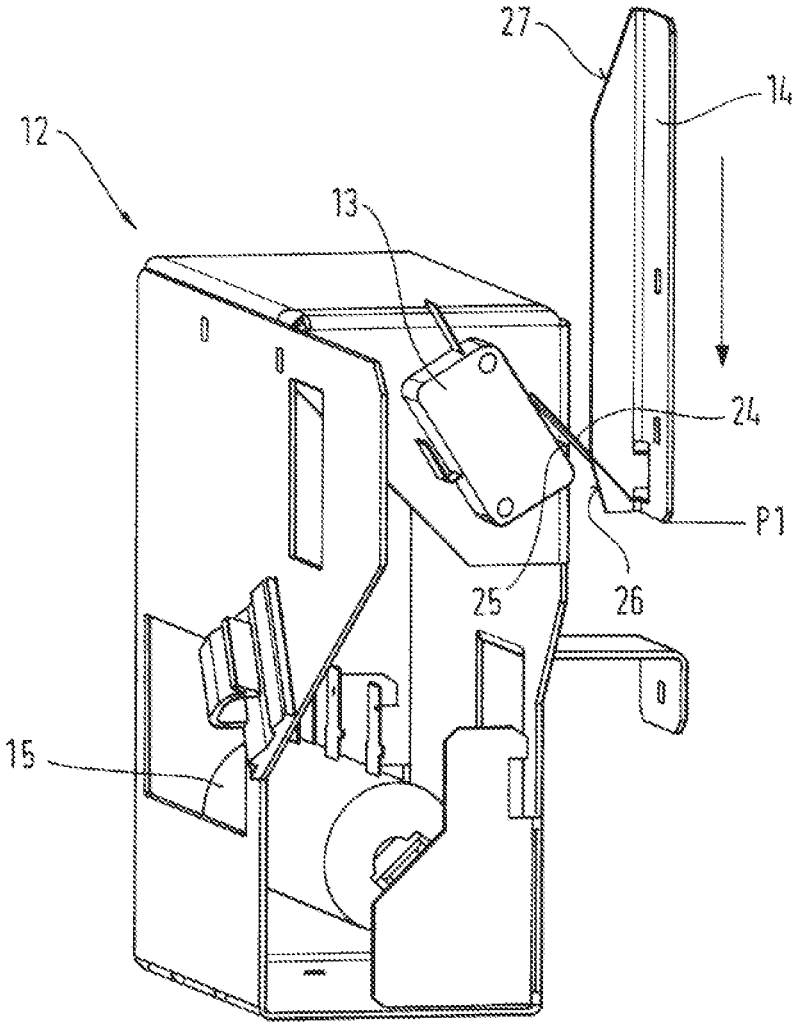
FIG. 3 shows components of a control facility of the vapor extractor device according to FIG. 1 in a first switching state.

FIG. 3 shows an enlargement of the control facility 12 in a first operating position. It shows the switch 13, which is arranged on a housing of the control facility 12 and has a switching lever 24 for actuating a touch element 25. The switching lever 24 projects into a path, which is crossed by the rail 14 as the vapor extractor hood 7 is retracted or moves down. This causes the rail 14 to actuate the touch element 25 by way of the switching lever 24, when the vapor extractor hood 7 reaches the first retraction position P1 during the downward retraction. This activates slow movement mode L, in which the vapor extractor hood 7 is retracted at a speed of 12 mm/s or less.

The rail 14 preferably has a front slope 26, which means that the rail 14 does not push the switching lever 24 suddenly but over a predetermined time period in the direction of the touch element 25.

Figure 4:
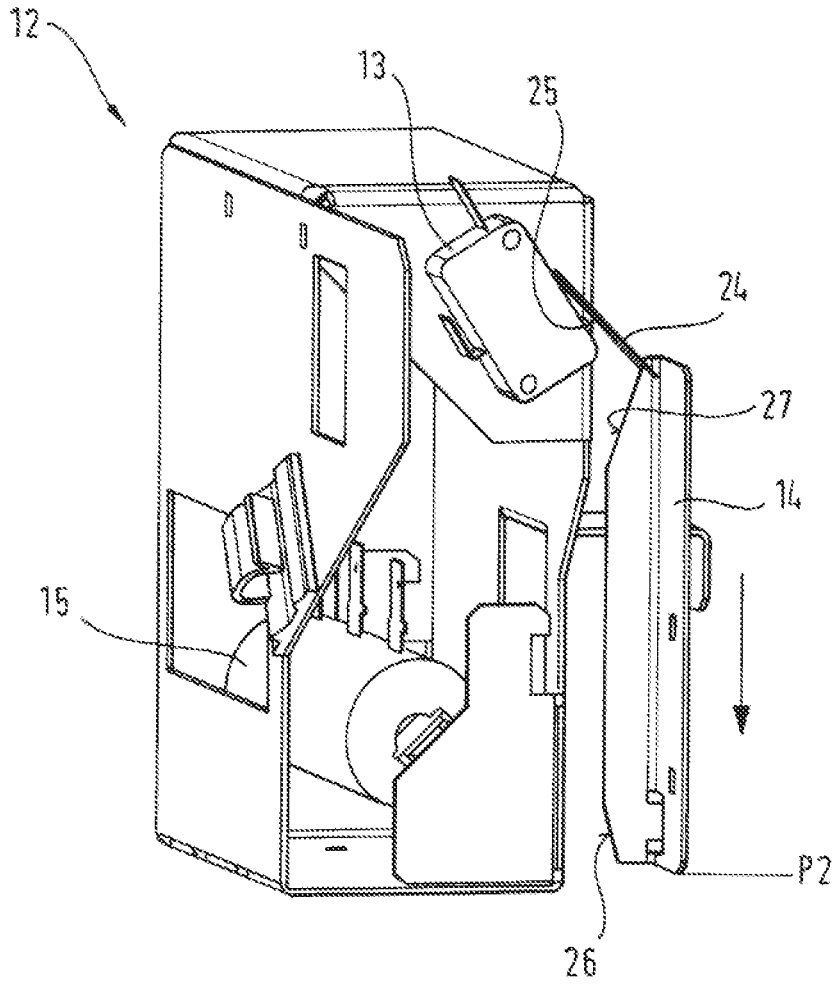
FIG. 4 shows the components of a control facility from FIG. 3 in a second switching state.

The rail 14 has a limited longitudinal extension, as shown in FIG. 3 and FIG. 4. In particular the rail 14 has a rear slope 27 in the direction of the retraction direction at the rear end. The longitudinal extension of the rail 14 or of the slopes 26, 27 corresponds to a distance between the first retraction position P1 (e.g. 80 mm before the closing position is reached) and a second retraction position P2 (e.g. 2 to 5 mm before the closing position is reached). This distance is dimensioned so that reverse switching takes place again when the vapor extractor hood 7 reaches the second retraction position P2 during its retraction movement. Actuation of the switch 13 by the rail 14 ends, so that a reverse switch is made from slow movement mode L to fast movement mode S. When the second retraction position P2 is reached, the drive motor 9 therefore drives the vapor extractor hood 7 again at the high first speed in the retraction direction, until the vapor extractor hood 7 reaches its closing position within the housing 2.

Figure 5:
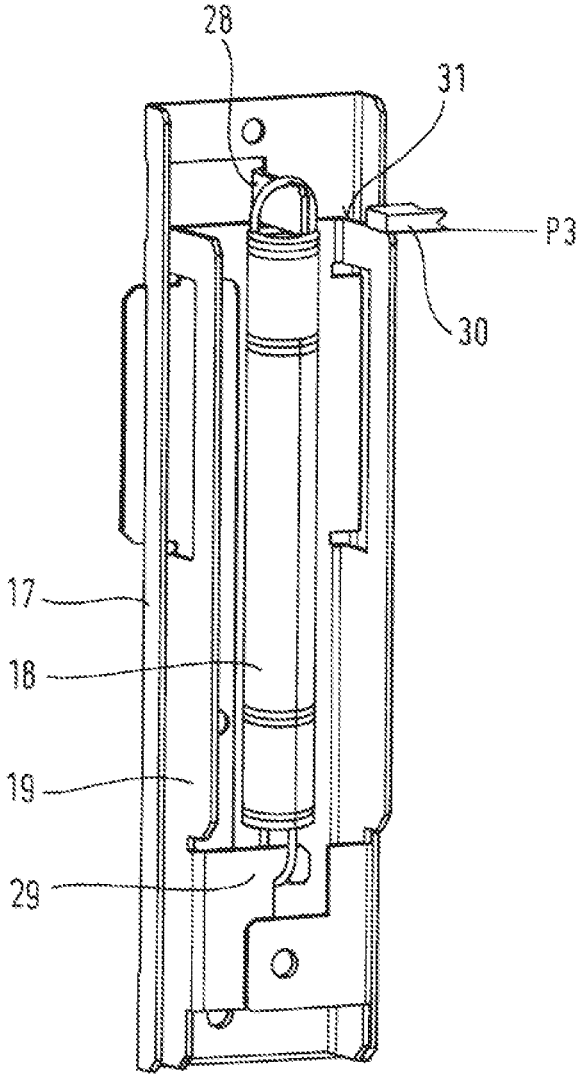
FIG. 5 shows a carriage and spring arrangement according to FIG. 1 for reducing the force of weight of the vapor extractor hood at the start of its actuation.

FIG. 5 shows an enlargement of an exemplary arrangement of the guide rail 17 and the carriage 19, which are inserted into one another and are both punched and bent from sheet metal. The guide rail 17 has a tab 28. The carriage 19 can be displaced in an upward and downward direction in the guide rail 17. A further tab 29 is configured on the carriage 19 on an end opposite the tab 28 of the guide rail 17. The ends of the (tension) spring 18 are caught in the tabs 28, 29.

A retracted position with untensioned spring 18 is shown, as is assumed when the vapor extractor hood 7 is in a third retraction position P3. The third retraction position P3 is located by way of example between the first and second retraction positions P1, P2 and in particular 65 mm before the closing position.

Figure 6:
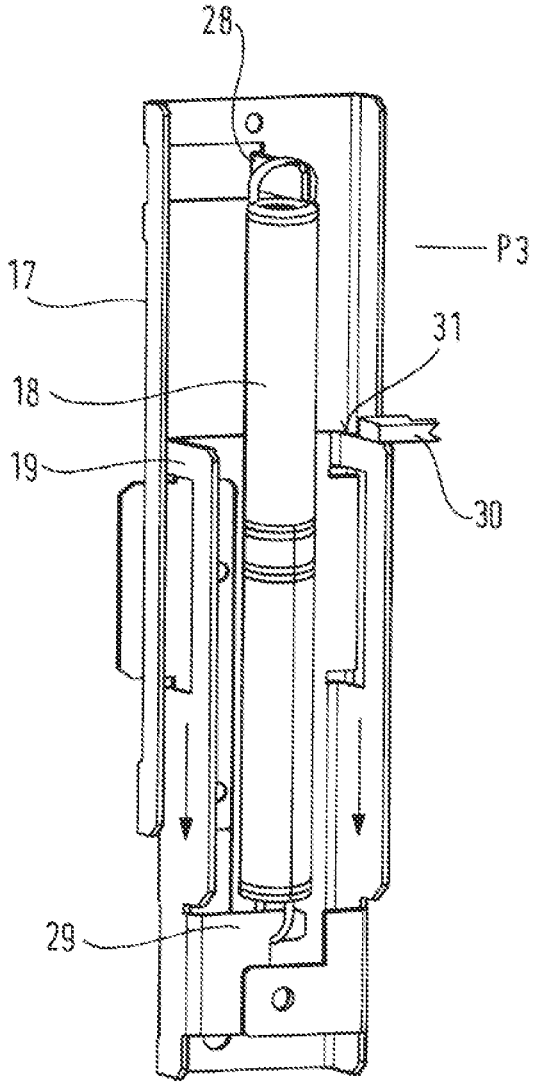
FIG. 6 shows the arrangement according to FIG. 5 as actuation continues.

When the vapor extractor hood 7 is retracted into the housing 2, the carrier 30 of the vapor extractor hood 7 reaches the carrier stop 31 of the carriage 30 in the third retraction position P3 so that the carrier 30 and the carrier stop 31 engage. Further downward movement of the vapor extractor hood 7 causes the carrier 30 to push the carrier stop 31, and therefore also the carriage 19 and the end of the spring 18 fastened to the carriage 19, in a downward direction. This tensions the spring 18, causing it to counteract a force of the drive motor 9 moving the vapor extractor hood 7 in a downward direction and the force of the weight of the vapor extractor hood 7, as shown in FIG. 6.

As the vapor extractor hood 7 is retracted therefore, in addition to slow movement, the weight of the visible or vapor extractor hood 7 is also reduced in that two of the tension springs 18 illustrated (other springs such as scroll springs for example are also possible) are incorporated in particular on the right and left in the housing 2.

The present invention is of course not restricted to the illustrated exemplary embodiment.

Other types of spring can also be used as elastic elements instead of the tension spring shown.

Other motor types can also be used to change the direction of movement of the vapor extractor hood 7 instead of a direct current motor and a polarity reversal of a direct current voltage present. Where applicable these are then activated by way of different controllers, to bring about a desired displacement direction for the vapor extractor hood 7.

In particular when a multiphase motor is used as the drive motor, a distance covered by the movement of the vapor extractor hood can also be detected by a motor controller in order to determine when the retraction positions are reached electronically.

Instead of the arrangement comprising the rail 14 and the exemplary mechanical switch 13 other components and switching principles can also be used, which comprise for example a light barrier or a reed switch.

The invention claimed is:

1. A vapor extractor device, comprising:

a vapor extractor hood;

a drive motor that moves the vapor extractor hood between a fully open position and a closed position, said drive motor being controlled to reduce a downward retraction speed of the vapor extractor hood between a predetermined first retraction position and a predetermined second retraction position when the vapor extractor hood is retracted, the first retraction position and the second retraction position being between the fully open position and the closed position; and a spring that exerts an upward urging force on the vapor extractor hood only when the vapor extractor hood is between a predetermined third retraction position and the closed position, the third retraction position being the same as the first retraction position or between the first retraction position and the closed position.

2. The vapor extractor device of claim 1, wherein the drive motor is controlled to cancel the reduced retraction speed when the vapor extractor hood reaches the second retraction position.

3. The vapor extractor device of claim 1, further comprising a position determination facility operably connected to the drive motor and configured to determine at least the first retraction position.

4. The vapor extractor device of claim 3, wherein the position determination facility is a mechanical switch.

5. The vapor extractor device of claim 4, wherein the position determination facility has a rail with a front slope in a retraction direction to operate as an actuation element for actuating the switch.

6. The vapor extractor device of claim 1, further comprising a resistor which is connected in series to the drive motor and bypassed as a function of at least one retraction position of the vapor extractor hood, said drive motor having a drive speed configured as a function of voltage.

7. The vapor extractor device of claim 1, wherein the drive motor is a direct current motor, and further comprising a diode connected parallel to the resistor such as to bypass the resistor in the event of an extension polarity.

8. The vapor extractor device of claim 7, wherein the direct current motor is a brushless direct current motor.

9. The vapor extractor device of claim 1, wherein a movement speed is not intentionally reduced when extending the vapor extractor hood upward.

10. The vapor extractor device of claim 1, further comprising:

a housing in which the vapor extractor hood is housed when the vapor extractor hood is in the closed position; and a carrier arranged on the vapor extractor hood or on the housing, said carrier being configured to engage with the spring at the third retraction position.

11. The vapor extractor device of claim 10, wherein the third retraction position is identical to the first retraction position.

12. A cooking appliance, comprising:

a housing; and a vapor extractor device including a vapor extractor hood, and a drive motor that moves the vapor extractor hood between a fully open position and a closed position, said drive motor being controlled to reduce a downward retraction speed of the vapor extractor hood between a predetermined first retraction position and a predetermined second retraction position when the vapor extractor hood is retracted, the first retraction position and the second retraction position being between the fully open position and the closed position; and a spring that exerts an upward urging force on the vapor extractor hood only when the vapor extractor hood is between a predetermined third retraction position and the closed position, the third retraction position being the same as the first retraction position or between the first retraction position and the closed position, wherein the vapor extractor hood is housed in the housing when the vapor extractor hood is in the closed position.

13. The cooking appliance of claim 12, wherein the drive motor is controlled to cancel the reduced retraction speed when the vapor extractor hood reaches the second retraction position.

14. The cooking appliance of claim 12, further comprising a position determination facility operably connected to the drive motor and configured to determine at least the first retraction position.

15. The cooking appliance of claim 14, wherein the position determination facility is a mechanical switch.

16. The cooking appliance of claim 15, wherein the position determination facility has a rail with a front slope in a retraction direction to operate as an actuation element for actuating the switch.

17. The cooking appliance of claim 12, further comprising a resistor which is connected in series to the drive motor and bypassed as a function of at least one retraction position of the vapor extractor hood, said drive motor having a drive speed configured as a function of voltage.

18. The cooking appliance of claim 12, wherein the drive motor is a direct current motor, and further comprising a diode connected parallel to the resistor such as to bypass the resistor in the event of an extension polarity.

19. The cooking appliance of claim 18, wherein the direct current motor is a brushless direct current motor.

20. The cooking appliance of claim 12, wherein a movement speed is not specifically reduced when extending the vapor extractor hood.

21. The cooking appliance of claim 12, further comprising:

a carrier arranged on the vapor extractor hood or on the housing, said carrier being configured to engage with the spring at the third retraction position.

22. The cooking appliance of claim 21, wherein the third retraction position is identical to the first retraction position.

* * * * *